United States Patent [19]

Dreyfuss

[11] Patent Number: 4,935,122

[45] Date of Patent: Jun. 19, 1990

[54] MINERAL SEPARATOR SYSTEM

[76] Inventor: William C. Dreyfuss, P.O. Box 353, East St., Austin, Nev. 89310-0353

[21] Appl. No.: 184,001

[22] Filed: Apr. 20, 1988

Related U.S. Application Data

[63] Continuation-in-part of Ser. No. 943,850, Dec. 22, 1986, abandoned, which is a continuation of Ser. No. 677,380, Dec. 3, 1984, abandoned.

[51] Int. Cl.[5] ..... B03C 1/30; B03B 7/00

[52] U.S. Cl. ..... 209/39; 209/208; 209/212; 209/232

[58] Field of Search ..... 209/1-3, 209/12, 39, 40, 142, 208, 212-214, 223.1, 224, 228, 231, 232, 478; 210/222, 223, 695; 55/2, 3, 100; 204/155, 156, DIG. 5

[56] References Cited

U.S. PATENT DOCUMENTS

| | | | |
|---|---|---|---|
| 1,024,109 | 4/1912 | Troy | 209/212 |
| 1,657,405 | 1/1928 | MacLaren | 209/223.1 |
| 2,088,364 | 7/1937 | Ellis et al. | 209/214 |
| 3,140,714 | 7/1964 | Murphy, Jr. et al. | 209/2 UX |
| 3,466,154 | 9/1969 | Hori et al. | 209/214 X |
| 3,608,718 | 9/1971 | Aubrey, Jr. et al. | 209/214 |
| 3,687,834 | 8/1972 | Candor | 55/2 X |
| 3,693,792 | 9/1972 | Lang | 209/212 |
| 3,720,312 | 3/1973 | Shook et al. | 209/228 X |
| 3,824,516 | 7/1974 | Benowitz | 209/212 X |
| 3,966,590 | 6/1976 | Boom et al. | 209/214 X |
| 3,970,546 | 7/1976 | Webb et al. | 209/3 |
| 4,003,830 | 1/1977 | Schloemann | 209/212 X |
| 4,070,278 | 1/1978 | Hunter | 209/212 |
| 4,083,774 | 4/1978 | Hunter | 209/212 |
| 4,106,627 | 8/1978 | Watanabe et al. | 209/212 X |
| 4,166,788 | 9/1979 | Druz et al. | 209/39 |
| 4,187,170 | 2/1980 | Westcott et al. | 209/39 X |
| 4,277,329 | 7/1981 | Cavanagh | 209/212 |
| 4,278,549 | 7/1981 | Abrams et al. | 204/155 X |
| 4,281,799 | 8/1981 | Oder | 209/214 X |
| 4,303,504 | 12/1981 | Collins | 209/232 X |
| 4,313,543 | 2/1982 | Paterson | 209/212 |
| 4,428,837 | 1/1984 | Kronenberg | 210/222 |
| 4,560,484 | 12/1985 | Friedlaender et al. | 210/223 X |

FOREIGN PATENT DOCUMENTS

| | | | |
|---|---|---|---|
| 0017588 | 10/1980 | European Pat. Off. | 209/212 |
| 0038767 | 10/1981 | European Pat. Off. | 209/214 |
| 0729487 | 12/1942 | Fed. Rep. of Germany | 209/232 |
| 2444578 | 4/1976 | Fed. Rep. of Germany | 209/232 |
| 3610303 | 2/1987 | Fed. Rep. of Germany | 209/232 |
| 52-74170 | 6/1977 | Japan | 209/40 |
| 53-67167 | 6/1978 | Japan | 209/224 |
| 0028206 | 1/1910 | Sweden | 209/214 |
| 0725709 | 4/1980 | U.S.S.R. | 209/3 |
| 0963563 | 2/1982 | U.S.S.R. | 209/39 |
| 0917860 | 4/1982 | U.S.S.R. | 209/214 |
| 1364362 | 1/1988 | U.S.S.R. | 209/213 |
| 0337759 | 5/1929 | United Kingdom | 209/232 |
| 2025268 | 1/1980 | United Kingdom | 209/223.1 |

OTHER PUBLICATIONS

"*Electronics Engineers' Handbook*", Fink ed., McGraw-Hill, pp. 1-30.

"*Standard Handbook for Electrical Engineers*", Fink ed. McGraw-Hill, pp. 8-3; 8-4.

*Primary Examiner*—Margaret A. Focarino
*Assistant Examiner*—Edward M. Wacyra
*Attorney, Agent, or Firm*—Frank P. Presta

[57] ABSTRACT

A mineral separator system providing for the removal of conductor and semiconductor materials from a pulp fluid containing nonconducting materials. Pairs of spaced magnet assemblies provide alternate or successive magnetic fields obliquely across a separation chamber through which the pulp fluid flows. Eddy currents set up in the conductors cause the conductor particles to migrate to a wall in accordance with the orientation of the magnetic field. Electrical stimulation of the semiconductors through the pulp fluid causes the semiconductors to have eddy currents induced therein.

29 Claims, 6 Drawing Sheets

MINERAL SEPARATOR SYSTEM

CROSS-REFERENCE TO RELATED APPLICATIONS

This application is a continuation-in-part of application Ser. No. 943,850, filed Dec. 22, 1986, now abandoned, which is a continuation of Ser. No. 677,380, filed Dec. 3, 1984, which abandoned.

BACKGROUND OF THE INVENTION

The present invention relates generally to mineral separator systems and, more particularly, to the removal of non-magnetic conductor and non-conductor particles from a mineral bearing pulp fluid, the fluid being either a liquid or a gas.

The methods of recovery of a desired mineral from a mined mineral bearing pulp containing contaminants vary widely, even in the recovery of a particular mineral. These methods range from simple methods, such as panning for gold, to elaborate methods, such as physical separation processes, hydrometallurgical processes and pyrometallurgical processes. Extraction of ferromagnetic substances with the use of magnets is known in the art. Processes that separate out non-ferromagnetic substances by the use of magnets is not known in the art.

An art that can be considered to be related to mineral recovery is the recovery of municipal "waste" for recycling. One method known in this art involves the steps of shredding the waste and classifying the shredded waste into light and heavy fractions, each having therein items suitable for recycling, with the heavy fraction including, among other substances, ferromagnetic and non-ferromagnetic metals. The ferromagnetic metals can be extracted by conventional means, such as by the use of electromagnets. A method using magnets in the recovery of non-ferromagnetic materials from waste is described in U.S. Pat. No. 4,003,830 issued to Ernst F.R.A. Schloemann. This patent describes material separating apparatus for directing non-ferromagnetic conductor materials into a sliding stream and steady-state magnet means that establish in the path of the stream a series of oppositely directed magnetic fields that induce in the conductor non-ferromagnetic materials eddy currents that draw the associated conductor materials laterally out of the stream, thus isolating them from the non-conductors.

A problem relating to the apparatus taught by Pat. No. 4,003,830 is that the stream of materials is substantially a flat or planar stream. Such an orientation is necessary since a flat or planar row of magnets is used, and the conductive materials must intercept the curved alternate fields of magnetic force before eddy currents are set up in the conductive non-ferromagnetic conductor materials to be extracted. Thus, only a solid stream can be used, for a fluid stream would by nature be a three-dimensional stream. Accordingly, a pulp fluid could not be used in the apparatus described in this patent. Ferromagnetic conductors cannot be separated by this teaching because of the use of curved magnetic fields in the apparatus. Also, it is noted that semiconductor non-ferromagnetic materials cannot be recovered by the Schoelmann apparatus. In addition, the force of gravity is not a factor in the recovery of the non-ferromagnetic materials.

Another patent that teaches a method for the recovery of conductive, non-ferromagnetic fragments in waste material by use of a magnetic field is U.S. Pat. No. 4,083,774, granted to Jack A. Hunter. Hunter teaches the use of a magnetic field across the path of moving waste fragments with the conductive fragments generating eddy currents and resulting drag forces proportional to the conductivity of each conductive fragment so that different types of materials have differing descent trajectories into successively positioned zones relating to varying drag forces and varying densities.

A problem with the apparatus of Pat. No. 4,083,774 is that the field is rectilinear, that is, the magnets do not generate a field except one laterally between one another. This arc of magnetic force between adjacent magnets must be intercepted by the conductive fragments in a manner similar to the Schloemann apparatus. It is apparent that a three-dimensional fluid-occupied chamber having cross-magnetic fields is not possible in the Hunter teaching. For this reason, the force of gravity as a force utilized in the separation of the conductive non-ferromagnetic particles from the non-conductive particles is not found in Hunter. It is also noted that Hunter does not assume the presence of non-conductive materials. This is important, for it is a key factor of the problem to be solved in the extraction of minerals in mining procedures. Finally, Hunter does not deal with semiconductors.

An additional patent relating generally to the moving of electrically conductive non-magnetic components of waste material in U.S. Pat. No. 3,824,516 issued to Sander Benowitz. Eddy forces in conductor materials are described. This invention, however, relates to the handling and movement of conductive, non-magnetic materials, not the separation of conductive, non-magnetic materials from non-conductive materials.

A patent describing the separation of electrically conducting particles from mixtures containing electrically non-conductive particles by conveying the mixture through an angularly oriented magnetic field is described in U.S. Pat. No. 4,277,329 issued to Patrick E. Cavanagh.

SUMMARY OF THE INVENTION

Accordingly, it is an object of the present invention to provide a system for separating electrically conductive, non-ferromagnetic materials from a pulp fluid containing non-conductive materials as well. Further references in this application to non-ferromagnetic materials are intended to mean conductors.

It is another object of this invention to provide a system for separating conductive, non-ferromagnetic materials from a pulp fluid also containing non-conductive materials by establishing an alternating or successive magnetic field in a separation chamber through which the fluid pulp is passed.

It is another object of this invention to provide a system for separating conductive, ferromagnetic materials from a pulp fluid also containing non-conductive materials by establishing an alternating or successive magnetic field in a separation chamber through which the fluid pulp is passed.

It is a further object of this invention to provide a system for the separation of conductive non-ferromagnetic materials from a fluid pulp containing non-conductive materials by inducing eddy currents in the conductive, non-ferromagnetic materials so as to impede the horizontal flow of the conductive materials in the flow of pulp fluid and to cause the conductive materials to migrate to a wall of the separation chamber through which the pulp fluid flows.

Yet another object of the present invention is to provide a system having a plurality of opposed magnet assemblies defining opposite walls of a separation chamber, the magnet assemblies providing oblique, alternating or successive fields of magnetic force that induce eddy currents and perpendicular eddy forces in conductive non-ferromagnetic particles contained in a pulp fluid flowing through the separation chamber.

The present invention also provides a system for separating both electrically conductive and certain semiconductive materials from a pulp fluid containing non-conductive materials as well.

The present invention also provides a system for separating a mixture of different conductive materials from a pulp fluid.

The mineral separator system in accordance with the present invention comprises at least one pair of opposed magnet assemblies and a pair of opposed walls connected to the magnet assemblies, the pair of magnet assemblies and the pair of walls defining an elongated separation chamber having opposed inlet and outlet orifices. In one embodiment, the pair of magnet assemblies have a plurality of alternate, opposed, staggered magnet poles that generate alternately directed, oblique, generally parallel magnetic fields across the elongated chamber between the pair of magnet assemblies in directions oblique to the longitudinal axial center of the separation chamber. A pulp fluid containing a mixture of particles of non-conductive materials and at least one type of conductive, non-ferromagnetic material is introduced through an inlet orifice to the chamber. The particles of conductive, non-ferromagnetic material are capable of having eddy currents induced therein. Also included is a means for pressurizing the pulp fluid in a fluid stream through the inlet orifice and through the separation chamber through the alternately directed oblique magnetic fields, so that eddy currents are induced in the particles of conductive non-ferromagnetic material and lines of eddy forces are generated in a direction substantially perpendicular to the oblique magnetic fields. The particles of conductive, non-ferromagnetic material are retarded and separated from the particles of non-conductive material in the fluid stream of fluid pulp. Stream cutters or draw pumps, or a combination of both, are used to direct the retarded particles of conductive, non-ferromagnetic material through downstream outlet ports to a concentrate recovery apparatus. The remaining tailings of the pulp fluid after removal of the conductive, non-ferromagnetic materials are directed to an outlet orifice of the separation chamber. From the foregoing discussion, it will be apparent that fluid drag forces contribute to the separation process.

The fundamental principle used in particle separation is the differences in particle settling velocities in a dynamic fluid environment which is determined by the combination of driving forces of momentum, gravity, eddy forces and the fluid drag forces. The drag force is determined by particle size, shape, and relative velocity in the fluid. Large particles move more quickly through the fluid than small particles given the same driving force. Thus, for example, dense particles settle faster than non-dense particles of the same size and shape. The embodiments of this invention include designs that take into consideration differences in particle size, shape, density and conductivity to effect a separation of non-ferromagnetic (conductive) materials from the non-conductive materials. Particles released into a stream flow will assume a stratification in the stream flow according to particle characteristics. One separation phenomenon used herein is where large non-dense particles settle slower than dense particles as settling first begins. This occurs as a result of the combination of low velocity drag, momentum and buoyancy. The resulting separation is used as a separation aid to the embodiments described herein. Secondly, strong eddy forces are used as a primary means of separation of conductors and eddy forces enhance natural settling of dense conductor particles over other particles. These two effects combine to permit a third method of placing the recovery means in such a way as to cause a separation of one particle type from another. Thus, separation occurs.

A plurality of separation chambers may be used that are mounted in substantially vertical alignment. The magnet assemblies may be rotated ninety degrees (90°) and used as side walls to the separation chamber. The oblique magnetic fields may be directed in a number of ways across the chambers both extending over a range of oblique angles relative to the axial center of the chamber in a general up and down direction but also in a general side-to-side direction.

The particles of non-ferromagnetic material may be either conductive materials or semiconductive materials. The semiconductive materials can be stimulated to behave as conductive materials, i.e., to be capable of having eddy currents induced therein. This is accomplished by having electrical circuits or wires carrying current positioned within or adjacent to the separation chamber to stimulate the semiconductors. An electrolyte may also be added to the pulp fluid to aid in the electrical stimulation of the semiconductors.

The present invention will be better understood and the objects and important features, other than those specifically enumerated above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teachings herein, and such other embodiments or modifications are intended to be reserved especially as they fall within the scope and spirit of the subjoined claims.

DESCRIPTION OF THE PREFERRED EMBODIMENTS

Figure 1:
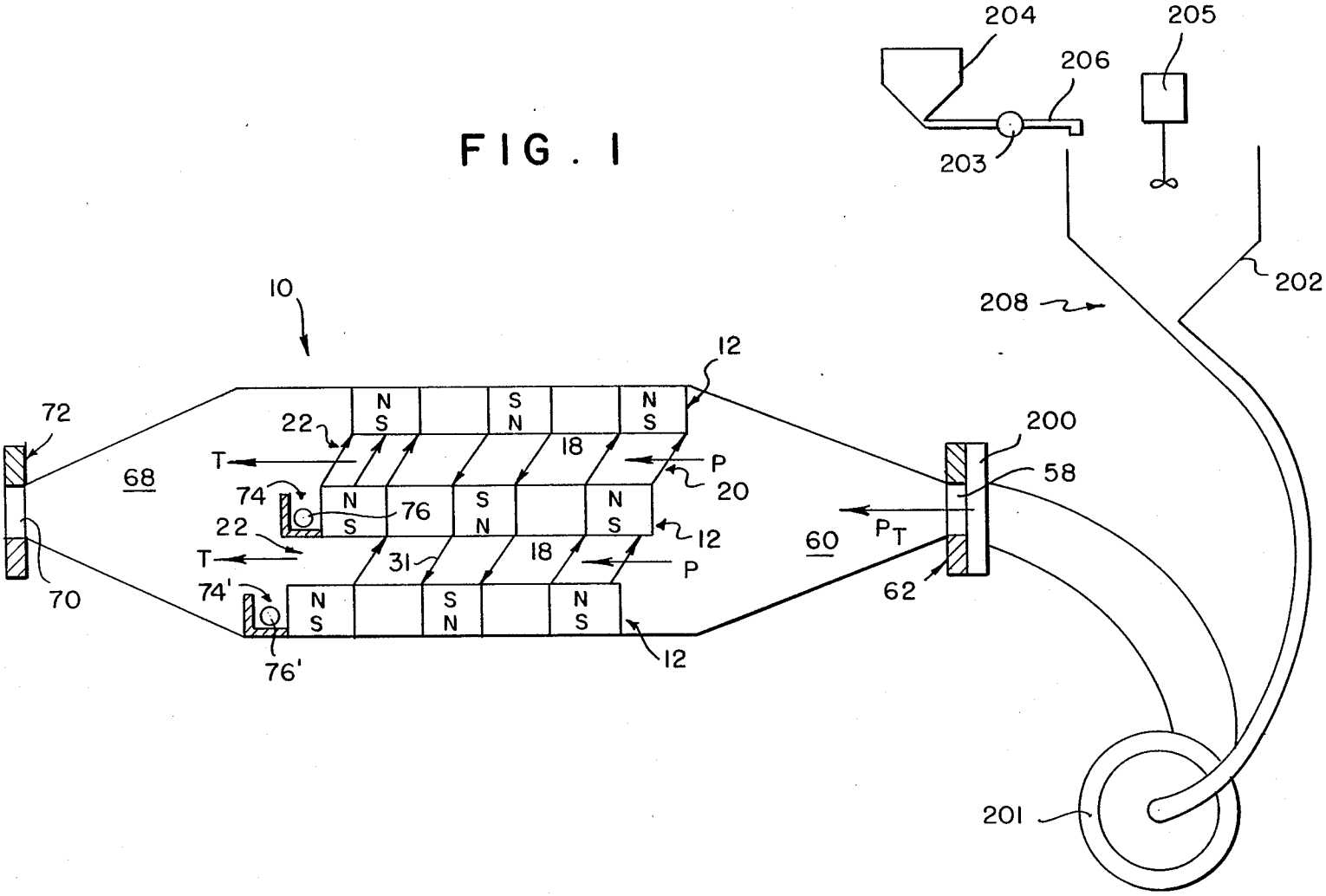
FIG. 1 is a schematic side view of a mineral separator apparatus constructed in accordance with the present invention.

Reference is now made to the drawings and in particular to FIGS. 1–13 in which identical or similar parts are designated by the same reference numerals throughout.

A mineral separation system 10 is shown in schematic sectional side view in FIG. 1. For purposes of illustration, three assemblies 12 are aligned in general parallel, vertical relationship, i.e., one on top of the other. A pair of opposed vertical walls 14 and 16 indicated in the top view of FIG. 3 are connected to each of the three magnet assemblies 12. Each magnet assembly 12 is generally spaced from and opposed to the adjacent magnet assembly or assemblies, and each magnet assembly 12 is substantially flat, i.e., has substantially flat, opposed surfaces. In the embodiment shown in FIGS. 1 and 2, magnet assemblies are generally horizontal so that they, along with vertical walls 14 and 16, define two elongated separation chambers 18 that each have opposed inlet and outlet orifices 20 and 22, respectively. Separation chambers 18 are generally rectangular in cross-section, as indicated in the schematic cut-away end view shown in FIG. 2. Separation chambers 18, like magnet assemblies 12 are vertically aligned and generally horizontal with the long dimension of the rectangular cross-section extending horizontally.

Figure 3:
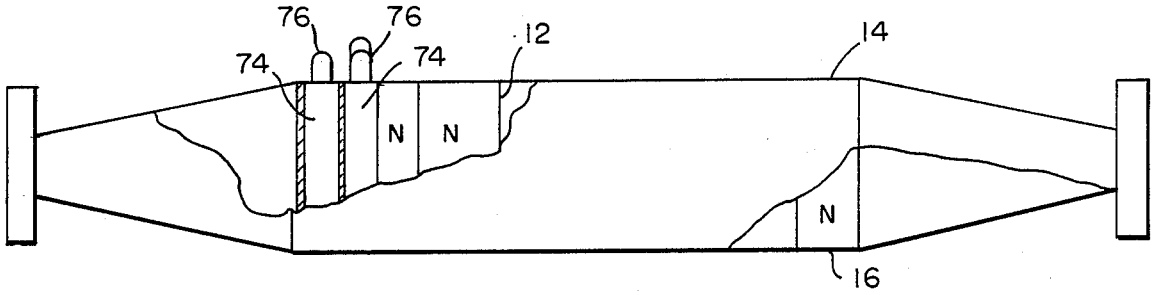
FIG. 3 is a top view of the apparatus of FIG. 1, partly in section.
Figure 4:
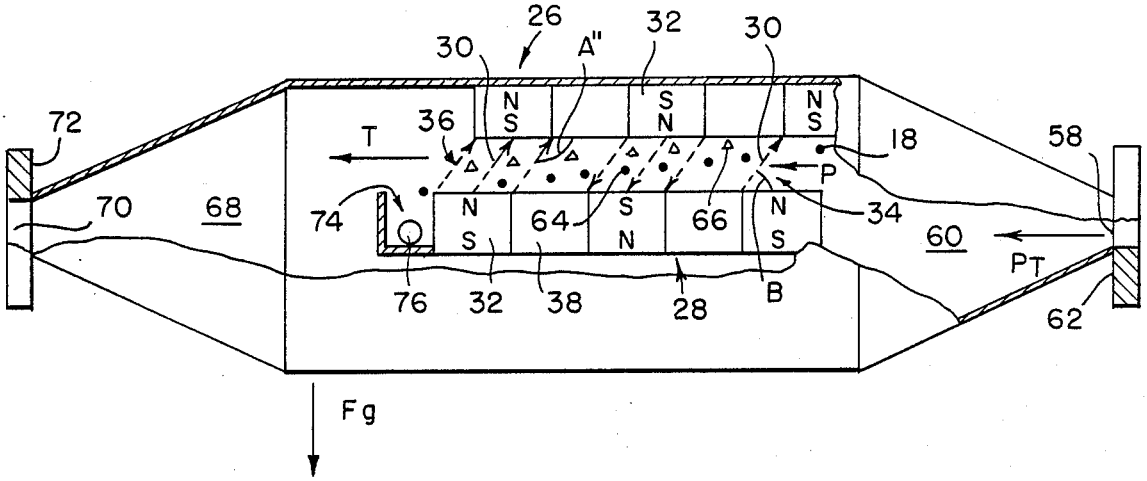
FIG. 4 is an isolated schematic side view of the upper separation chamber of the apparatus illustrated in FIG. 1, with parts broken away and shown in section.

FIG. 4 illustrates in schematic upper cross-sectional side view the single elongated upper separation chamber 18′ of separation chamber 18 of FIG. 1 defined in part by a pair of opposed horizontal upper and lower magnet assemblies 26 and 28 that are particularized illustrations of a pair of typical assemblies 12. Likewise, separation chamber 18′ is a particularized representation of a typical separation chamber 18. Walls 14 and 16 are connected to magnet assemblies 26 and 28 and further define separation chamber 18′. Magnet assemblies 26 and 28 have a plurality of alternate opposed staggered magnet poles, designated as north poles "N" and south poles "S" that produce or generate alternately directed or orientated, generally parallel magnetic fields 30 that extend across chamber 18′. Each magnet assembly 26 and 28 includes a plurality of substantially parallel, aligned magnet bodies 32 having lengths, which can be seen in FIG. 3, that are transversely disposed at regular intervals relative to the elongated direction of chamber 18′, which in turn has opposed inlet and outlet orifices 34 and 36, respectively, which are particularized inlet and outlet orifices of the two inlet and outlet orifices 20 and 22 illustrated in FIGS. 1 and 2.

Upper magnet assembly 26 has three magnet bodies 32, each of which is generally square in cross-sectional side view but may have a different configuration. Each magnet body 32 has a particular magnetic pole orientation hat is unlike or opposed to the magnetic pole orientation of the adjacent parallel aligned magnet body 32. Lower magnet assembly 28 has three magnet bodies 32 each of which is generally configured the same as magnet bodies 32 of upper magnet assembly 26. Each magnet body 32 of upper magnet assembly 26 is positioned at a staggered, horizontally measured interval from a mating magnet body 32 of opposite magnetic pole of lower magnet assembly 28. Parallel fields of magnetic force are produced, or generated, between the mating magnet bodies of opposite magnetic poles across chamber 18′ at a selected oblique angle relative to upper and lower magnet assemblies 26 and 28. This oblique angle is generally transverse to the elongated direction of chamber 18′ In fact, a plurality of parallel oblique angles are formed by the magnetic fields 30.

Figure 5:
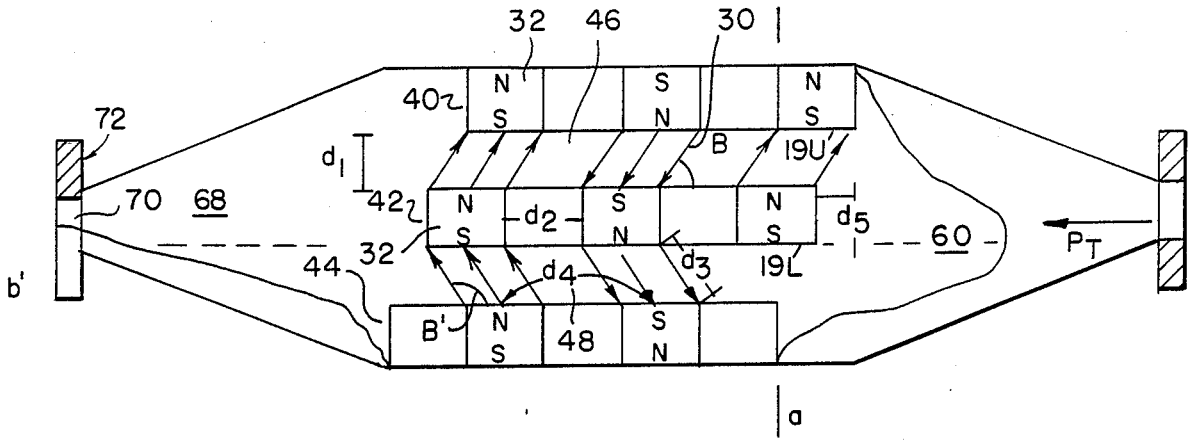
FIG. 5 is a diagrammatic view of the placement of the magnet bodies of the magnet assemblies of the present apparatus showing both oblique and acute upstream orientations of the magnetic fields.

Magnet bodies 32 are spaced from one another to form transverse interstices between them. Blocks 38 made of a non-ferromagnetic material are positioned in the interstices. Magnet bodies 32 are positioned according to the oblique angle desired and in accordance with known laws of magnetism. A cross sectional side view of the separator system in FIG. 1 is illustrated in modified form in FIG. 5. FIG. 5 illustrates portions of three adjacent magnet assemblies 12, designated as upper portion 40, middle portion 42 and lower portion 44. Upper and lower chamber portions 19U and 19L are formed between the above-named magnet portions. Selected distances are the vertical distance between magnet assemblies portions 40, 42 and 44, designated as d1; the horizontal distance between magnet bodies 32 in each of the magnet assembly portions, designated as d2; and the horizontal distance between magnet assemblies 12, designated as d5. Varying the distance dl varies the size of chamber portion 46. Varying the distance d5 adjusts the oblique angle of the magnetic field across chamber portion 46. The mating magnetic fields 48 can occur between adjacent magnet bodies 32 in the same magnet assembly. This possible "short circuit" magnetic field passes through a distance designated as d4 in FIG. 5. Distance d4 follows an annular path. When magnetic field distance d3 is greater than distance d4, short circuiting can result; therefore, distance d3 must be less than distance d4. Varying d2 adjusts the distance between magnet bodies so that the d4 distance is greater than the d3 distance. Magnetic fields of the same polarity can be generated between magnet assemblies in a successive pattern in the configuration shown in FIG. 5*a*. In the successive arrangement, magnet bodies 32 are of the same polarity within the assemblies 40, 42 and 44 and of opposite polarity between assemblies so that successive parallel magnetic fields are formed. Magnet distances are governed to prevent short circuiting of magnetic fields to adjacent magnet bodies of the opposite assembly.

Figure 5A:
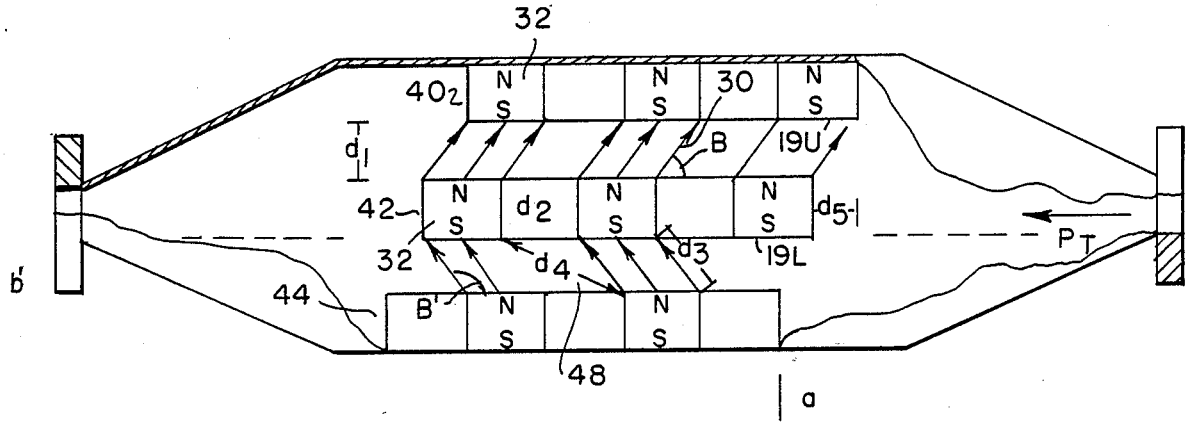
FIG. 5*a* illustrates a successive magnet arrangement including an illustration of two magnetic field orientations between magnet assemblies.

FIG. 5*a* illustrates a separator configuration similar to FIG. 5 further having successive magnet orientations in each magnet assembly. The function of distances d3, d5, d2 and dl of FIG. 5*a* are similar to the preferred distances d3, d5, d2 and dl of FIG. 5. Short circuiting can occur where distance d3 is greater than distance d4. A combined application can be used where distance d4 is greater than d3. Thus, the separator shown in FIG. 5*a* can have more than one set of upstream angles B. Each magnet body 32 has magnetic fields 30 and 48' which are divided between the nearest opposing magnet bodies 32 and the second nearest opposing magnet body 32.

Figure 2:
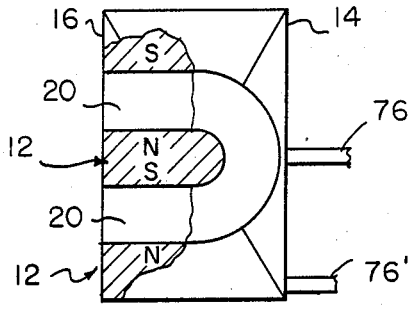
FIG. 2 is an end view of the apparatus shown in FIG. 1, partly in section.

The isolated separation chamber 18' and isolated upper and lower magnet assemblies 26 and 28, discussed in relation to FIG. 4 and in the discussion relating to FIG. 5 can be applied to FIGS. 1 and 2.

That is, a plurality of magnet assemblies 12 having a plurality of opposed, alternately staggered magnetic poles generate alternately directed, parallel magnetic fields 30 obliquely oriented relative to magnetic assemblies 12 across each of the elongated separation chambers 18 between each of the magnet assemblies 12. Attention is now directed to FIGS. 1 and 2 where a pulp fluid designated as the total pulp fluid, Pt, is shown being pressurized by a pressure source 208 through the main feed or inlet port 58 of system 10 into a pulp fluid feed compartment 60, which is positioned adjacent to separation chamber 18. Main inlet port 58 is formed in the wall of compartment 60, which is positioned adjacent to separator chamber 18. A flange 62, which surrounds main inlet port 58, is connected to a pipe flange 200 leading from a pulp feed preparation area.

The pulp fluid contained within feed compartment 60 is forced through the two inlet orifices 20 of chamber 18 as designated by arrows marked "P". The pulp fluid contains a mixture of particles of non-conductor materials and at least one type of conductor material. Pulp fluid containing particles of more than one type of conductor material will be discussed later in relation to other embodiments of the invention. As is known, conductor materials are capable of having eddy currents induced within by a change in magnetic flux within the conductors by the relative motion thereof through a magnetic field. The fluid that acts as a medium to continuously propel the particles can be either a liquid or a gas. The particles, which are minerals of various kinds, both metals and non-metals, are pre-sized by screening or other methods. As mentioned, particles that seriously interfere with the eddy separation process are removed.

The particular embodiment shown in FIGS. 1 and 2 is directed towards the recovery of particles of conductor-type materials, such as gold or copper. The present invention can also be applied towards the recovery of particles of semiconductor-type materials, such as metal sulfides and metal oxides. Additionally, some ferromagnetic conductors are recovered in this methods. Particles of non-conductor materials can be separated from the particles to be recovered, as will be discussed later, so as to isolate the desired particles, such as the recovery of quartz from a pulp fluid containing copper.

The embodiments of FIGS. 1, 2, 3 and 4 are directed towards the recovery of a single conductive material, such as gold or silver, from a pulp fluid P that also contains at least one and possibly a number of types of particles of non-conductive materials. The pulp fluid P is pressurized from pump 201 and sump 202 through each of inlet orifices 20 and through each of the separation chambers 18 in a fluid stream so that all the particles are forced through the alternate magnetic fields indicated generally in direction as 31 in FIG. 1 and as 30 in FIG. 4. FIG. 4 shows in particular pulp fluid P being forced through inlet orifice 34 and chamber 18' through magnetic fields 30 indicated as 31 in FIG. 4. In FIG. 4, conductor particles 64 of non-ferromagnetic material, shown as circular particles, have eddy currents induced in them while non-conductor particles, shown as pointed particles, are free of eddy currents and are generally relatively free of any effects from passing through the fields of magnetic force 30. As will be further explained below, the eddy currents induced in conductor particles 64 generate an eddy force substantially perpendicular to the direction of the parallel magnetic fields 31 to retard the movement of conductor particles 64 relative to the movement of non-conductor particles 66 in the fluid stream. This retardation adds to the force of gravity, designated as Fg in FIG. 4, so that conductor particles 64 migrate both downwardly and towards outlet orifice 74 and outlet orifices 74 of FIG. 1. Non-conductor particles 66 pass through outlet orifices 36 and 22 respectively. Non-conductor particles 66 settle downwardly in the laminar flow in chamber 18 at a rate less than the conductor particles 64. FIG. 1 shows the pulp P separated from the conductor particles 64, that is, the tailings, designated as T, passing through outlet orifices 22 into a tailing compartment 68 through a main outlet port 70 formed in the wall of tailings through a main outlet port 70 for connection to a tailings deposit area.

Retarded conductor particles 64 are recovered from the fluid stream of pulp fluid by way of a bottom outlet port 74 that is formed in association with lower magnet assembly 28 shown in FIG. 4 at the downstream end of chamber 24. It is to be understood throughout this discussion that FIG. 4 shows a detail of the embodiment of bottom outlet port 74 of FIG. 1, and so a bottom outlet port 74 of FIG. 4 is also positioned at each downstream end of elongated chambers 18 of FIG. 1. Outlet ports 74 open into substantially horizontal tubes 76 and lead to a concentrate recovery area. FIGS. 1-14 4 illustrate an embodiment of the invention that has magnet assemblies 12 vertically oriented, that is, stacked vertically, with the actual assemblies being horizontally disposed. Side walls 14 and 16 are vertically disposed. In such an orientation, the oblique, parallel magnetic fields 31 and 30 shown in FIGS. 1 and 4 form obtuse upstream angles "A" with the upper magnet assembly. This is particularly shown in FIG. 4 with upper magnet assembly 26 and magnetic fields 30 forming oblique angle A. In addition, FIGS. 1-14 4 indicate the fields of magnetic force 31 forming upstream angles "B" with the lower magnet assembly; angles B are particularly shown in FIG. 4 as formed by magnetic fields 30 and lower magnet assembly 28.

FIGS. 1–4 illustrate an embodiment of the invention having horizontal magnet assemblies 12 and vertical side walls 14 and 16. An analysis of the lines of force created in this configuration is explained as follows.

A reaction to the relative movement of conductor 64 through magnetic fields 31 and 30 in FIGS. 1 and 4 is caused by eddy forces. The magnitude of the reaction is represented by the vector cross product of velocity of the conductor 64 and magnetic fields 31 and 30. The resultant eddy force is composed of a horizontal component which opposes the fluid drag from the relative movement of pulp "P" against particles 64 and a vertical component which drives conductor 64 downwardly toward magnet assembly 28 of FIG. 4. Within the scope of this disclosure, it is possible to laterally shift the relative positions of magnet bodies 28 so that obtuse upstream angles are formed with the lower magnet assemblies 42 and 44 of FIG. 5. Conductor particles 64 of FIG. 5, having intercepted obtuse upstream angles B' in chamber 19L as illustrated in FIG. 5, will have an upward vertical component of eddy force. Both lower magnet assembly acute and obtuse upstream angles are illustrated an angles B and B' in chambers 19U and 19L respectively in FIG. 5. The aforesaid eddy components, in various combinations with the force of gravity, particle buoyancy, fluid drag, and particle inertia produce new separation environments. For example, two conductor particles of varying conductivities, of similar size shape and specific gravity will have similar paths of travel when subjected to the same moving fluid environment and differing paths of travel when the moving fluid environment includes magnetic eddy related forces.

For example, the extent of separation between conductor 64 and non-conductor 66 of FIG. 4 depends upon the relative position of both particles in relation to upper magnet assembly 26 upon entering chamber 18,, and the relative size, shape, and specific gravity of both particles. Outlet port 74 of FIG. 4 must be positioned so that conductors 64 are intercepted and non-conductors 66 are not intercepted. It is possible for the settling velocity of the eddy influenced conductor 64 to be less than non-conductor 66 where the particle size of the non-conductor 66 is larger than conductor 64.

Another method of this teaching is to apply obtuse upstream angles relative to the lower magnet assembly as is illustrated in the lower chamber 19L of FIG. 5 so that conductor particles are lifted upwardly against the upper magnet assembly and conductor movements are thus opposite to non-conductor movements. The parallel fields produced by magnet bodies 40, 42 and 44 of FIG. 5 are adapted to pass ferromagnetic materials untracted because the magnetic flux is uniform. The understanding of the description herein is that adjustments to the relative positioning of the said magnet bodies can be made so that magnet flux changes can be introduced to improve the recovery of ferromagnetic conductors. Other modifications to the field orientations shown in FIG. 5 are shown in FIG. 6.

Figure 6:
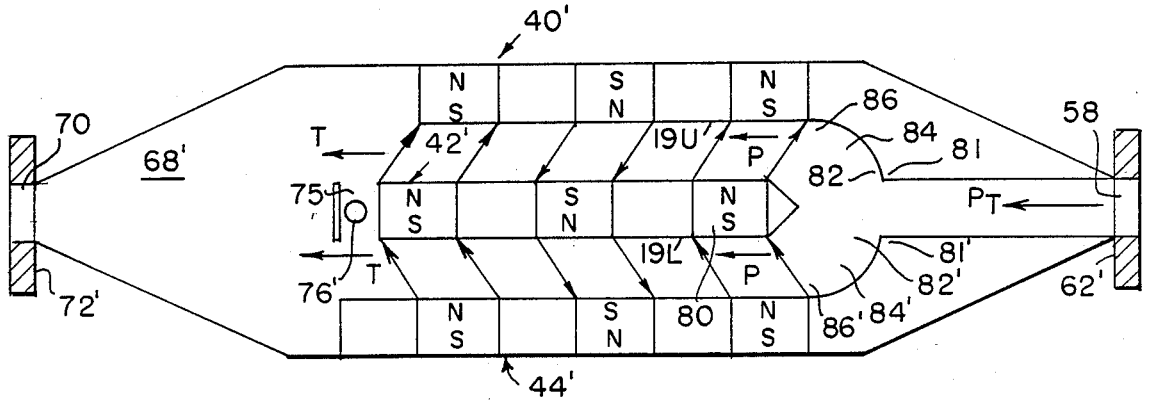
FIG. 6 is a schematic sectional side view of an apparatus incorporating opposed pulp feed diverters from both separating chambers, using a combination of magnetic field orientations.

FIG. 6 represents an adaptation of the methods employed in FIGS. 1 and FIGS. 5. FIG. 6 is a separator similar in construction to FIG. 1 having inlet and outlet chambers 60' and 68' respectively, and having inlet and outlet flanges 62' and 72'. Magnet assemblies 40', 42' and 44' represent upper, middle and lower magnet assemblies respectively as is also shown in FIG. 5. Chambers 19U' and 19L' illustrate similar magnetic field orientation to FIG. 5 in FIG. 6. FIG. 6 further includes a new method in addition to that illustrated in FIGS. 1, 4 and 5 involving the wedge shaped diverger 80, and a curved chute and curved chutes 81 and 81' comprising a generally vertical inlet portion 82 and 82', curved middle portions 84 and 84', and a generally horizontal outlet portion 86 and 86' for chambers 19U and 19L' respectively. Diverter apparatus is adapted to cause particles of the more dense materials to congregate at the surface of horizontal outlet portions 86 and 86', thus stratifying the more dense materials at the surface of the chute from the less dense particles of non-conductive material, a result that is caused by the differing accelerations of particles of differing densities as the particles pass through the changing direction of flow within the chute. Pulp entering separation chambers will be in a somewhat stratified condition with the less dense material farthest from the chute surface and the more dense material at the closest proximity to the chute surface. Pulp P enters inlet opening 58' to the general pulp-delivery area 60' through inlet openings 82 and 82' through the diverter apparatus through the chambers 19U' and 19L' where the tailings T is pressurized to the general outlet area 68, and outlet opening 70'. The concentrate recovery port 75 receives conductor concentrates for both chambers 19U' and 19L'. Horizontal outlet pipe 76' receives the fluid containing conductors and delivers the conductors to a concentrate receiving area. The teaching in FIG. 6 illustrates two separate methods in which conductors drift downwardly more rapidly than non-conductors to be recovered as in chamber 19U' and where conductors drift upwardly away from non-conductors as is illustrated in chamber 19L' of FIG. 6.

Figure 7:
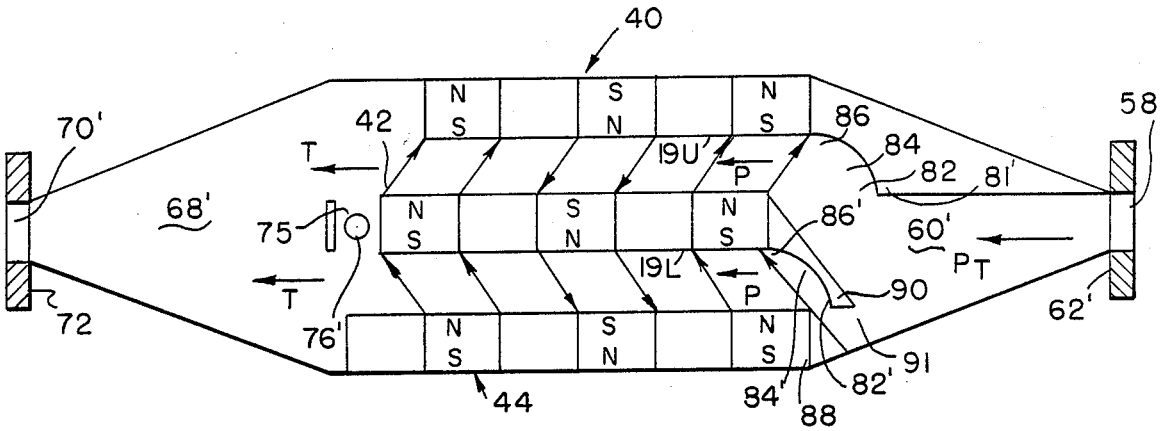
FIG. 7 is a schematic sectional side view of an apparatus incorporating pulp diverters of the same direction into separating chambers of different magnetic field orientation.

Yet another method involves a diverter apparatus illustrated in FIG. 7. FIG. 7 depicts a modification of chamber 19L' of FIG. 6 and represents a cross sectional view similar to that of separator system 10.

FIG. 7 represents an enclosed separator system having side walls (not shown), pulp feed inlet and tailings outlets 58' and 70' respectively, pulp feed chambers and tailings chambers 60' and 68' respectively, and upper and lower separation chambers 19U' and 19L'. Also shown are curved chutes 81' and 90 with vertical inlet openings 82 and 82', curved middle portions 84 and 84', and horizontal outlet portions 86 and 86' respectively. Diverters 90 (upper surface) and 88 further define vertical inlet openings. Pressurized pulp enters inlet 58 from system 208 of FIG. 1, passes through pulp delivery area 60' through vertical diverter inlets 82 and 82', through horizontal diverter outlets through chambers 19U' and 19L' passing into general tailings chamber 68 and through outlet opening 70 for delivery to a tailings disposal area. Conductor particles are separated in chamber 19U' in a similar fashion to chamber 19U' of FIG. 6. Conductor particles in chamber 19L' are separated in a different manner.

Diverter 88 and curved chute 90 deflect all particles entering chamber 19L' against magnet assembly 42' so that conductors travel along the upper portion of chamber 19L' as non-conductors settle downwardly away from the conductors. Pulp containing separated conductor particles is recovered in the fluid flowing into recovery port 75 and through horizontal outlet 76' to a concentrate receiving area. It is apparent that the teachings of FIG. 7 rely on the force of gravity to part non-conductors from conductors. The teaching illustrated in FIGS. 1, 4 and 6 can be rotated 90 degrees (90°) about the longitudinal axis so that, for example, magnet bodies 12 in FIG. 1 become vertical side walls for chamber 18.

The resulting configuration tends to deflect conductors laterally across chamber 18. In FIG. 6, a similar result occurs when the entire FIG. 6 is rotated ninety degrees (90°) about the longitudinal axis of magnet body 42. This configuration tends to move conductors away from a general band formed by inlet chutes 82 and 82'. Still further, FIGS. 1 and 6 can be rotated ninety degrees (90°) about the latitudinal axis of magnet assemblies 12 (middle) and 41, respectively, having the inlet 58 and 58' for both separators concentric about the vertical axis. The force of gravity is not utilized in both orientations solely reliant on eddy forces to effect a separation of conductors from non-conductors.

Figure 8:
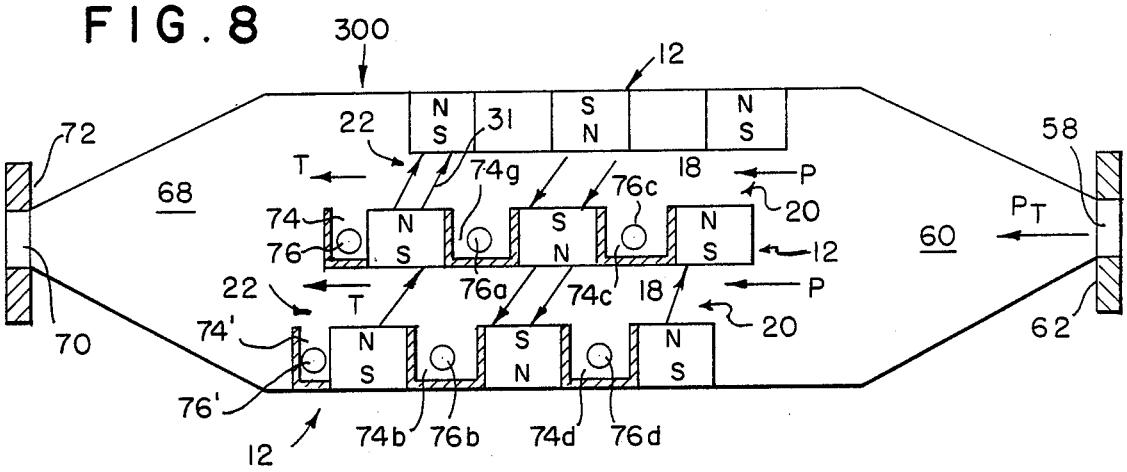
FIG. 8 is a schematic sectional side view of an apparatus having multiple recovery ports within the separating chambers.

Still another application of FIGS. 1 and 4 is shown in FIG. 8. FIG. 8 includes a separator system which is similar to FIG. 1 and 4 in all aspects, further having included outlet ports 74, 74', 74a, 74b, 74c and 74d leading to outlet tubes 76, 76', 76a, 76b, 76c and 76d adapted to recover conductors 64 of differing conductivities concurrently with further separations within the chamber 18 and 18'.

FIG. 8 depicts separator system 300 similar to separator system 10 of FIG. 1 further having inlet ports 74, 74', 74a, 74b, 74c, 74d. Side walls 14 and 16 (not shown) form an enclosed system through which pulp P is pressurized. Pulp Pt enters separator 300 through inlet opening 58, through general pulp inlet area 60 through inlet openings 20 through chambers 18 through outlet openings 22 to general tailings outlet chamber 68 through outlet opening 70 where the material is directed to a tailings deposit area. Conductor particles within fluidized pulp P develop electrical eddy forces as the particles pass through oblique parallel magnetic fields 31. Conductor particles of the greatest conductivity have the greatest electrical eddy forces generated therein and are deflected both against the pulp flow P and downwardly to the lower portions of chamber 18. The most conductive particles are thus separated to outer ports 74c and 74d of the upper and lower chambers 18 respectively. Particles of intermediate conductivity are separated to outlet ports 74a and 74b. The least conductive particles moving with pulp P are separated and recovered by outlet ports 74 and 74'. One application of this method is for the separation of similar particles of similar size and varying conductabilities. Another application of the illustration of separator 300 of FIG. 8 is to separate conductor particles of varying size and similar conductivity. Fluid drag is proportionately the least for larger conductors having the greatest deflection so that they are selected to outlet ports 74c and 74d of FIG. 8. Smaller particles having proportionately more fluid drag are separated to outlet ports 74a and 74'. Intermediately sized conductor particles are thus separated to outlet ports 74a and 74b.

Applications of this teaching include particles of semiconductive characteristics wherein a current must be directly applied to the semiconducting particles to induce a conductive state within the particle.

Figure 9:
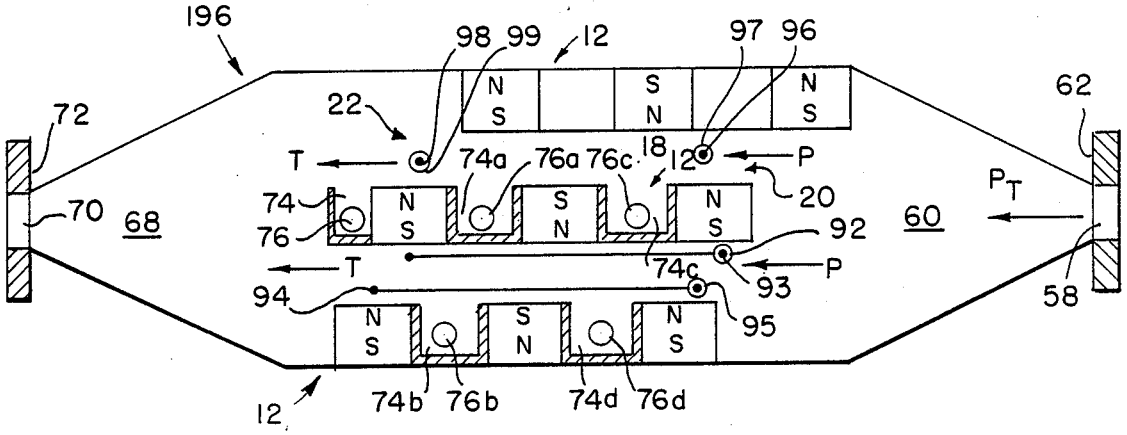
FIG. 9 is a schematic sectional side view of an apparatus having an electrical stimulation means across the separating chambers.
Figure 9A:
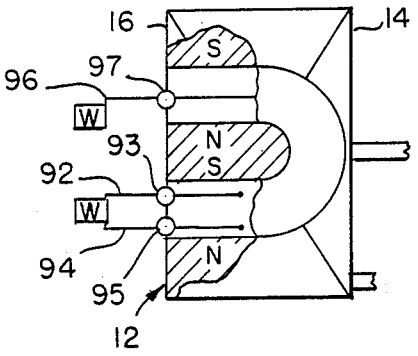
FIG. 9A is an end view of the apparatus shown in FIG. 9, partly in section.
Figure 12:
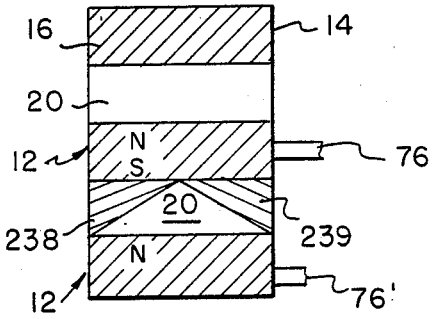
FIG. 12 is a schematic sectional end view of the pulp constrictor shown in FIG. 11.

FIG. 9 illustrates an example of two methods of application as FIG. 9 is similar in construction to FIG. 8. Conducting wires with appropriate insulation extending through side walls 16 have been placed into the arrangement of FIG. 8 as shown in FIG. 9 as lower chamber 18. The wires 92 and 94 of the lower chamber, and the wires 96 and 98 of the upper chambers are illustrated in the cut-away end view of FIG. 9 as FIG. 9A. Conducting wires 92, 94, 96 and 98 extend into separation chambers 18 through insulators 93, 95, 97, and 99 respectively. Power source, W, is connected to and supplies electrical voltage between wire 93 and 95 and 97 and 99 as shown in FIG. 9A. Two parallel wires, one wire 92 extending along the bottom portion of the middle magnet assembly 12 and the other wire 94 extending along the top portion of the lower magnet assembly 12, are adapted to apply electrical currents to pulp "P." These currents can vary in polarity, be alternating in various frequencies to cause the various semiconductors flowing between these wires to stimulate the various junction orientations of the semiconducting crystal particles. Illustrated in the upper chamber of FIG. 9 are wires 96 and 98 substantially transverse longitudinally across the ends of the chamber also extending through side walls 16 (not shown).

FIG. 9 embodies a separator system 196 similar to FIG. 8. System 196 is supplied with pulp fluid generally as is illustrated in FIG. 1. Separator 196 connects to flange 200 in FIG. 1 for the purposes of this illustration. Pulp pressurized from pump 201 of FIG. 1 through flange 200 enters inlet opening 58, through general receiving chamber 60 through inlet orifices 20 into chambers 18 through the electric currents flowing between conductors 92 and 94 and 96 and 98. Pulp P passes through outlets 22 through general tailings chamber 68 as tailings "T" and through tailings outlet opening 70 to a tailings deposit area. Semiconductor particles in pulp P are electrically stimulated to be more conductive so that eddy currents are generated in the semiconductive particles as the particles pass through the oblique parallel magnetic fields. Deflected semiconductor particles pass through outlet ports 74, 74', 74, 74a, 74b, 74c, 74d according to their relative conductivity.

System 196 can be further modified to increase the separation of semiconductor particles by the increase in electrical stimulation of the particles by increasing the conductive properties of the pulp fluid "P" by the addition of electrolytes. Pulp delivery system 208 of FIG. 1 includes chemical reservoir 204 capable of delivering electrolyte solution such as brine to sump 202. The electrolyte, such as a solution of common salt, passes through pipe 206 through valve 203 into sump 202 thereby causing the pulp to pass electrical currents. Aforementioned delivery of more conductive pulp "P" from system 208 of FIG. 1 to system 196 through flange 62 is combined with aforementioned electrical stimulation system 196.

Figure 10:
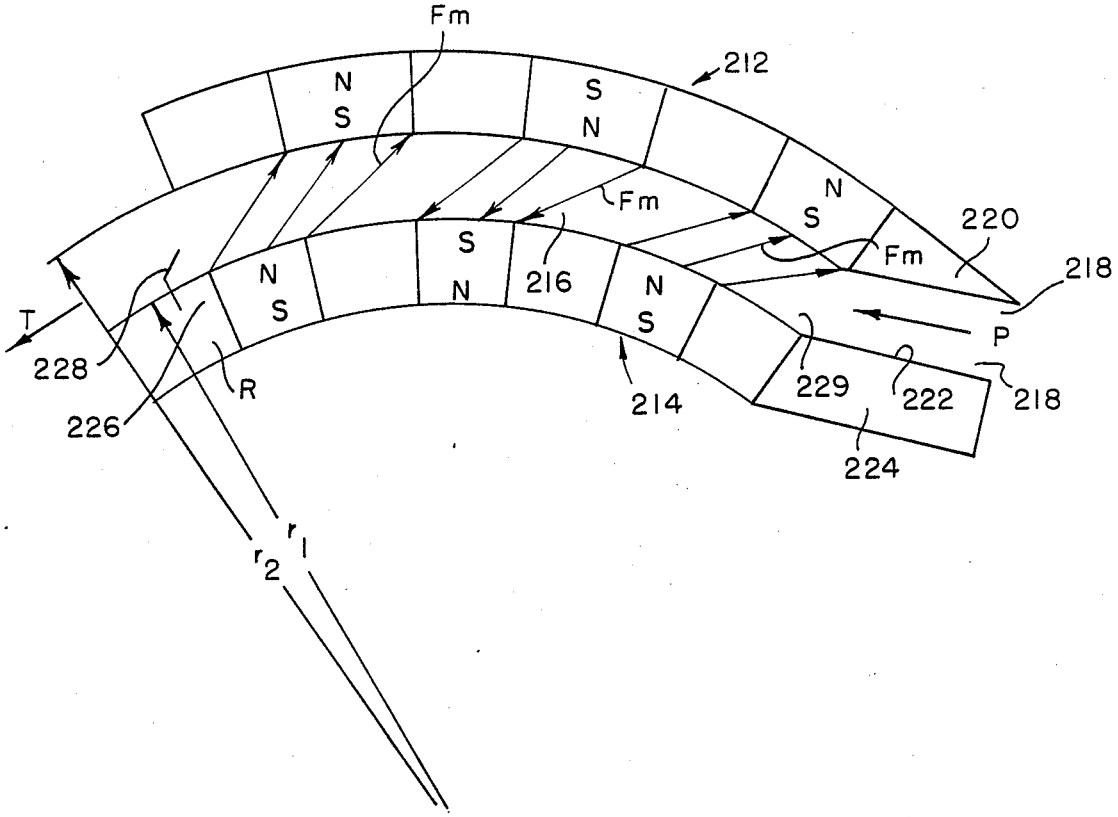
FIG. 10 is a schematic sectional side view of a curved separating chamber with pulp feed diverter.

FIG. 10 shows another method by which conductors and non-conductors are separated. Curved magnet assemblies 212 and 214 form a curved chamber 215 of generally rectangular cross section formed with side walls (not shown). Each assembly forms concentric arcs about a common axis of radius r1 and r2 for the inner and outer assembly respectively. Ramp structure 220 and 224 adjoins the inlet end of assembly 212 and 214 respectively and defines an oblique path to chamber 216. Pulp passes through inlet 218 through chamber 216 whereby conductors are separated to the surface of assembly 214 and removed through outlet 226 by stream cutter device 228. The remaining pulp containing non-conductors reports through tailings T. The ramp structure 220 establishes pulp particle momentum in a direction oblique to the chamber inlet orifice 220. This line of momentum intercepts the inner surface of assembly 214 so that particles enter chamber 216 generally close to assembly 14. Conductors intercept parallel magnetic fields Fm and are forced toward the assembly 214 to be recovered through outlet 226. Centrifugal force shifts non-conductors in pulp P away from the conductors and assembly 214, non-conductors are discharged through tailings T. The amount of centrifugal force opposing the force of gravity can be adjusted by controlling the rate of flow of pulp P through chamber 216 and thereby controlling the selectivity of the separation between conductors and non-conductors. The structure illustrated in FIG. 10 is adapted to operate in the vertical position and the horizontal position. The horizontal position is adapted to use centrifugal force to separate non-conductors from conductors. The vertical position is adapted to use gravity in combination with the other forces utilized in the horizontal position.

Figure 11:
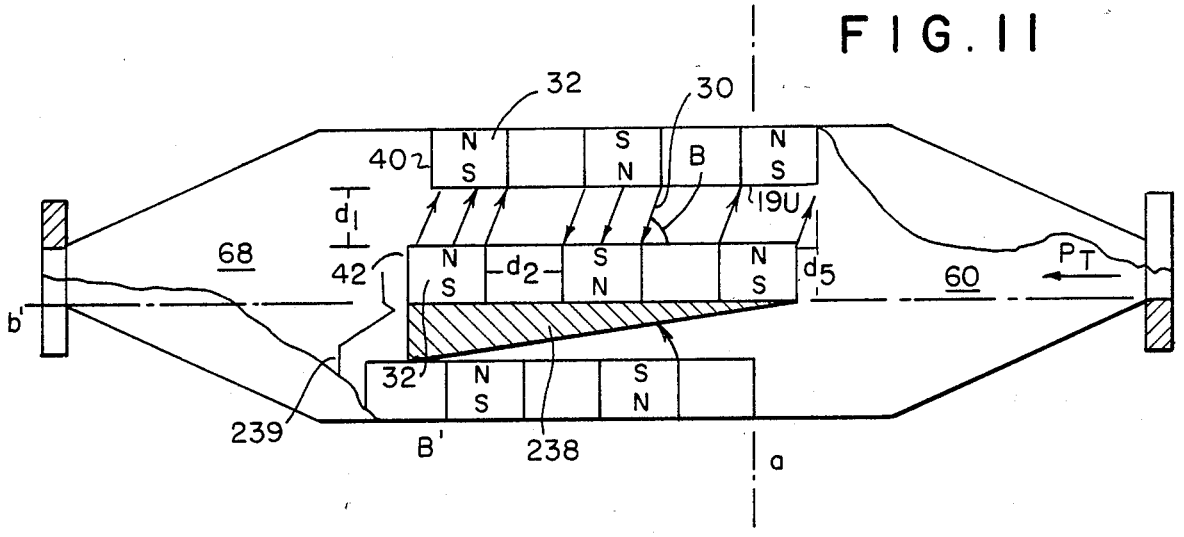
FIG. 11 is a schematic chamber having a pulp constrictor within the chamber
Figure 13:
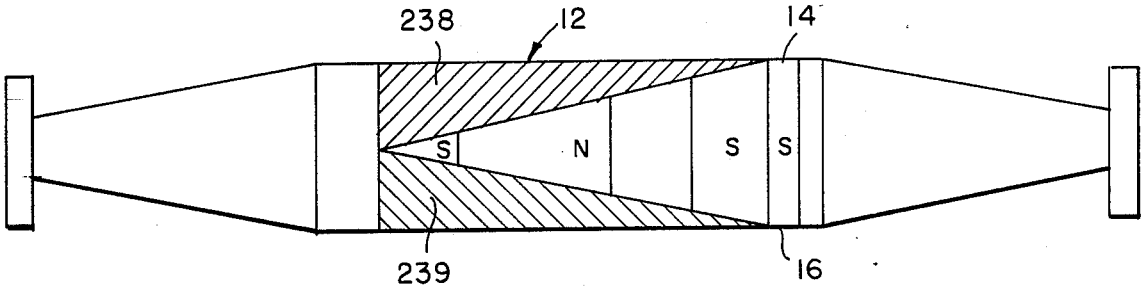
FIG. 13 is a schematic sectional bottom view of the pulp constrictor shown in FIG. 11.

The embodiments of FIGS. 5 and 7 can be further modified. A diverter is placed in chamber 19L so that flow is constricted within a specific area within the chamber. FIG. 11 shows a sectional side view of two pyramidal blocks of non-ferromagnetic material 238 ad 239 tapered into the chamber from the feed end into the discharge end further defining a triangular outlet passage. A schematic sectional end view along the "a" axis of FIG. 11 (shown as FIG. 12) illustrates the opening defined by blocks 238 and 239 in FIG. 11. FIG. 13 illustrates a bottom view of FIG. 11 of triangular blocks 238 and 239 within modified chamber 19L.

This inner chamber diverter physically constrains particulate flow into a laminar band of conductors of small cross sectional area and higher particulate density. Thus, the eddy separated particles are removed with a relatively small amount of cross sectional flow. A stream cutter known in the art is used in connection with the inner chamber diverter to select small amounts of conductor particles bearing flow.

What I claim is:

1. A mineral separator system, comprising, in combination:

at least one pair of opposed magnet assemblies and a pair of opposed walls connected to said magnet assemblies, said pair of walls and said at least one pair of magnet assemblies defining an elongated chamber having opposed inlet and outlet orifices, said at least one pair of opposed magnet assemblies having a plurality of alternately opposed, staggered magnetic poles generating alternately directed, generally parallel magnetic fields across said elongated chamber between said at least one pair of opposed magnet assemblies in directions oblique to the longitudinal axial center of said chamber;

a source of pulp fluid containing a mixture of particles of non-conductive material and at least one type of conductive material, said particles of conductive material being capable of having eddy currents induced therein;

means for pressurizing and passing said pulp fluid in a fluid stream through said inlet orifice and through said chamber through said laternately directed oblique magnetic fields, whereby eddy currents are induced in said particles of conductive material and lines of eddy force are generated in a direction substantially perpendicular to said oblique magnetic fields to retard said particles of conductive material and separate them from said particles of non-conductive material in said fluid stream; and means in said chamber for recovering said retarded particles of conductive material from said up fluid in said chamber before said pulp fluid passes through said outlet orifice.

2. A system according to claim 1, wherein said at least one pair of opposed magnet assemblies includes a plurality of magnet assemblies aligned in generally parallel substantially vertical relationship connected to said pair of opposed walls, said plurality of magnet assemblies and said pair of walls defining a plurality of generally parallel substantially vertically aligned chambers, said plurality of magnet assemblies having a plurality of opposed alternately staggered magnetic poles generating alternately directed oblique generally parallel magnetic fields transversely across each of said plurality of chambers between opposed pairs of said magnet assemblies, said means for passing said pulp fluid serving to pass said pulp fluid in a plurality of fluid streams through each of said chambers through said oblique magnetic fields, and said means for recovering said retarded particles serving to recover said retarded particles of conductive material from each of said plurality of chambers.

3. A system according to claim 1, wherein said at least one pair of opposed magnet assemblies includes vertically aligned, substantially horizontal upper and lower magnet assemblies.

4. A system according to claim 3, wherein said oblique, parallel, magnetic fields form obtuse upstream angles with said upper magnet assembly and acute upstream angles with said lower magnet assembly.

5. A system according to claim 4, wherein said means for recovering said retarded particles of conductive material is placed adjacent to the outlet end of the lower magnet assembly.

6. A system according to claim 5, wherein said means for recovering said retarded particles of non-ferromagnetic material includes a top outlet port formed in association with said upper magnet assembly, said top outlet port being adapted to pass said particles of non-conductive material from said chamber, whereby said particles for conductive material are isolated in said fluid stream and can be recovered from said fluid stream downstream of said top outlet port.

7. A system according to claim 4, wherein said conductive material is a plurality of particles of different types of conductive materials, and said means for recovering said particles of conductive material includes a plurality of bottom outlet ports formed in association with said lower magnet assembly, each outlet port being adapted to pass one type of said plurality of particles of different types of conductive material from within said chamber.

8. A system according to claim 4 further including a diverter means positioned outside said chamber proximate to said inlet orifice, said diverter means serving to deliver an accumulation of particles as on general strata adjacent to said upper magnet assembly, whereby causing a distinct separation between conductors and conconductors.

9. A system according to claim 4, wherein said at least one pair of magnet assemblies define generally concentrically curved upper and lower magnet assemblies, the radial points of said curvatures being below said lower magnet assembly, said system adapted to drive non-conductors outwardly toward the upper magnet assembly as eddy forces drive conductors toward the lower magnet assembly.

10. A system according to claim 9, further including diverter means outside said chamber proximate to said inlet orifice, said diverter means serving to accumulate a general particle band adjacent to lower magnet assembly.

11. A system according to claim 4, further including blocks of non-ferromagnetic material within said chamber adapted to confine the flow of separated particles within a small volume whereby the recovery means effects a more distinct separation.

12. A system according to claim 3, wherein said oblique, parallel magnetic fields form acute upstream angles with said upper magnet assembly and obtuse upstream angles with said lower magnet assembly.

13. A system according to claim 12, wherein said means for recovering said retarded particles of conductive material includes a top outlet port formed in association with said upper magnet assembly, said top outlet port being adapted to pass said particles of conductive material from said chamber.

14. A system according to claim 12 further including a diverter means positioned outside said chamber proximate to said inlet orifice, said diverter means serving to deliver an accumulation of particles as on general strata adjacent to said upper magnet assembly whereby causing non-conductors to settle away from conductors.

15. A system according to claim 1, wherein said at least one pair of opposed magnet assemblies includes horizontally aligned, substantially vertical first and second side magnet assemblies.

16. A system according to claim 15, wherein said oblique parallel magnetic fields form obtuse upstream angles with said first side magnet assembly and acute upstream angles with said second side magnet assembly.

17. A system according to claim 15, wherein said oblique parallel magnetic fields form acute upstream angles with said first side magnet assembly and obtuse upstream angles with said second side magnet assembly.

18. A system according to claim 1, wherein each of said pairs of magnet assemblies includes a plurality of substantially parallel aligned magnet bodies having lengths disposed transversely at regular intervals relative to the elongated direction of said chamber, each magnet body being opposite in magnetic pole to the adjacent parallel aligned magnet body, each said magnet body of one of said pair of magnet assemblies being positioned at a staggered, horizontally measured interval from a mating magnet body of opposite pole of the other of said pair of magnet assemblies, whereby alternately directed parallel magnetic fields are generated between mating magnet bodies across said chamber at a selected oblique angle relative to said pair of magnet assemblies.

19. A system according to claim 18, wherein said magnet bodies are spaced from one another to form transverse interstices, and wherein blocks made of a conductive material are positioned in said interstices.

20. A system according to claim 19, wherein the distance of said magnetic fields across said chamber between said mating magnets of opposite poles is less than the distance of the magnetic fields that would be induced between laterally aligned magnet bodies of opposite poles in the same magnet assembly of said pairs of magnet assemblies

21. A system according to claim 1 further including diverter means positioned outside said chamber proximate to said inlet orifice, said diverter means serving to loosely accumulate all particles into a general strata prior to entry into said chamber to cause a more distinct separation.

22. A system according to claim 21, wherein said diverter means includes a curved chute having a generally vertical inlet portion, a generally horizontal outlet portion and a curved middle portion joining said inlet and outlet portions, said outlet portion being in alignment with the upper portion of said chamber, said curved chute being adapted to cause particles of more dense non-ferromagnetic materials to congregate at the surface of said horizontal outlet portion to stratify said more dense particles from less dense particles of non-conductive material.

23. A system according to claim 1, wherein said particles of at least one type of conductive material include particles of a semiconductor material, said system further including electrical stimulation means associated with said chamber for applying current in multiple sequences to said pulp fluid to stimulate conductivity within said particles of semiconductor material to induce eddy currents therein when passing through said oblique magnetic fields.

24. A system according to claim 23, wherein said particles of at least one type of conductive material include particles of a semi-conductor material, said system further including means for adding electrolyte to said pulp fluid prior to entry into said chamber to increase the electrical conductivity of said pulp fluid for electrically stimulating said semiconductor materials to induce eddy. currents therein when passing through said oblique fields of magnetic force.

25. A system according to claim 1, wherein each of said pairs of magnet assemblies includes a plurality of substantially parallel aligned magnet bodies having lengths disposed transversely at regular intervals relative to the elongated direction of said chamber, each magnet body being the same in magnetic pole to the adjacent parallel aligned magnet body, each said magnet body of one of said pair of magnet assemblies being positioned at a staggered, horizontally measured interval from a mating magnet body of opposite pole of the other of said pair of magnet assemblies, whereby successively directed parallel magnetic fields are generated between mating magnet bodies across said chamber at a selected oblique angle relative to said pair of magnet assemblies.

26. A system according to claim 25, wherein the distance of said magnetic fields across said chamber between said mating magnets of opposite poles is less than the distance of the magnetic fields that would be induced between laterally aligned and adjacent magnet bodies of opposite poles in the opposite magnet assembly of said pairs of magnet assemblies.

27. A system according to claim 25, wherein said magnet bodies are spaced from one another to form transverse interstices, and wherein blocks made of a non-ferromagnetic material are positioned in said interstices.

28. A system according to claim 25, wherein the distance of said magnetic fields across said chamber between said mating magnets of opposite poles is greater than the distance of the magnetic fields that would be introduced between laterally aligned and adjacent magnet bodies of opposite poles in the opposite magnet assembly of said pair of magnet assemblies, said system adapted to produce a combination of oblique orientations of parallel magnetic fields.

29. A system according to claim 1, wherein said parallel magnetic fields are adapted to pass ferromagnetic particles.

* * * * *